United States Patent [19]

Sutton

[11] 4,020,778

[45] May 3, 1977

[54] HATCH COVER

[76] Inventor: Robert W. Sutton, Box 774, Port Orford, Oreg. 97465

[22] Filed: Feb. 13, 1976

[21] Appl. No.: 657,749

[52] U.S. Cl. ..... 114/203; 292/6

[51] Int. Cl.[2] ..... B63B 19/14

[58] Field of Search ..... 114/201 R, 203; 105/377; 292/6, 256.5; 49/317; 220/314

[56] References Cited

UNITED STATES PATENTS

| | | | |
|---|---|---|---|
| 991,548 | 7/1911 | Schmid | 292/6 |
| 1,212,372 | 1/1917 | Liptay | 292/6 |
| 2,447,464 | 8/1948 | Jenkins | 292/6 |
| 2,488,524 | 11/1949 | Castellano | 114/203 |
| 2,488,796 | 11/1949 | Baier | 114/201 R |
| 3,821,935 | 7/1974 | Adler | 114/201 R |

*Primary Examiner*—Trygve M. Blix
*Assistant Examiner*—Stuart M. Goldstein
*Attorney, Agent, or Firm*—Klarquist, Sparkman, Campbell, Leight, Hall & Whinston

[57] ABSTRACT

A hatch cover for closing and sealing a hatch opening has radial latching arms connected at their inner ends to a rotatable arm-actuating hub on the bottom side of the cover at ball-and-socket connections and loosely connected to the cover near their outer ends. In one rotational position of the hub the arms overlap and apply clamping pressure to the rim of the hatch opening and in a second rotational position of the hub the arm-clamping pressure is released and the arms are retracted from the rim to enable removal of the cover from the opening. The hub rides on camming surfaces of the cover which are shaped so that as the hub rotates in a hatch-closing direction, the arms first extend over the rim of the opening and then pivot into clamping engagement with the rim about their loose connections to the cover, urging the cover through such connections into tight seated engagement with the rim. A resilient sealing ring with double lips and carried by the cover engages the rim when the cover is seated to seal the hatch opening. A shaft extending through the cover and axially slidable and rotatable relative to it and the hub can be selectively engaged with the hub to rotate it. A handle fixed to the upper end of the shaft is used to engage and disengage the shaft and hub and to rotate the hub to activate the arms. The top surface of the cover is recessed to receive and store the handle flush with the cover surface when not in use.

18 Claims, 7 Drawing Figures

FIG.2
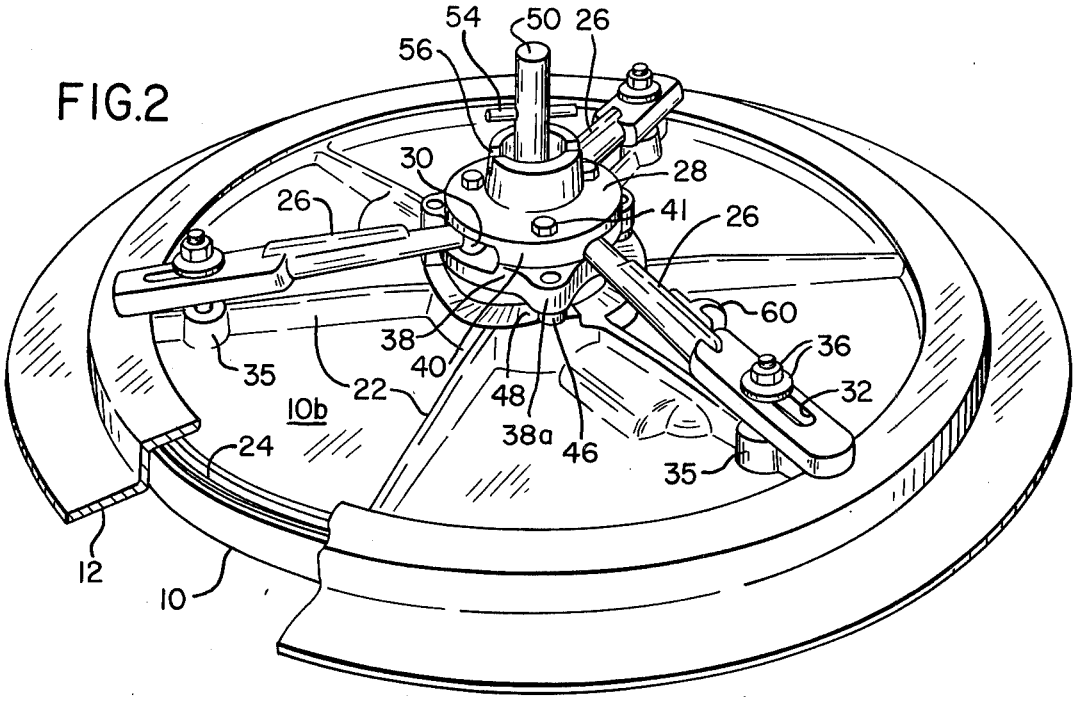
FIG.1
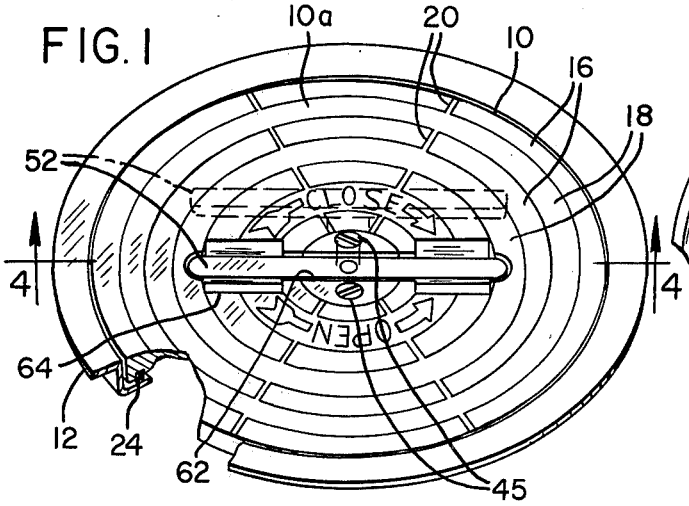
FIG. 3
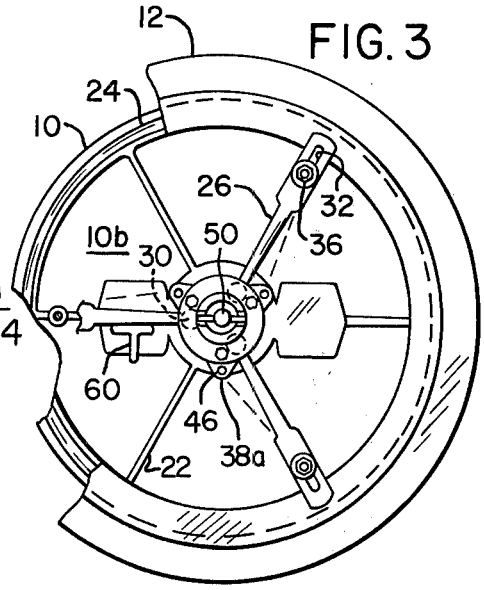
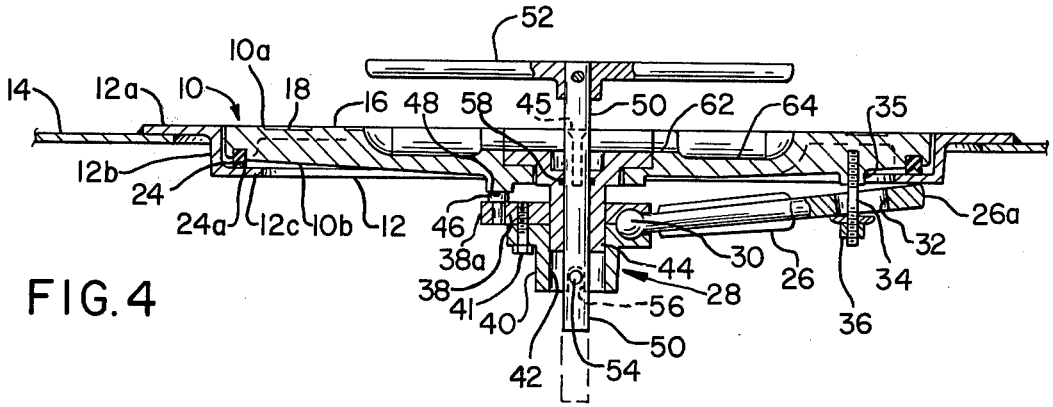
FIG.4

HATCH COVER

BACKGROUND OF THE INVENTION

1. Field of the Invention

The present invention relates to a hatch cover and especially a hatch cover for effectively closing and fluid sealing a hatch opening in a ship and analogous vessels.

2. Description of the Prior Art

Existing hatch covers for the hatch openings in ships are unsatisfactory because typically they do not effectively seal the hatch opening against the flow of fluid therethrough after repeated operation of the hatch-latching mechanism.

Additionally, the latching mechanisms of existing hatch covers typically employ some sort of screw action to clamp the cover tightly against the rim of the hatch opening. The screw threads of such mechanisms are subject to corrosion from exposure to salt water and are difficult or impossible to operate when corroded.

Moreover, the handles used to activate the latching mechanism of typical hatch covers must usually be removed from the cover when not in use and stored elsewhere because otherwise it would project above the surface of the hatch cover and deck and could trip someone unaware of its presence. Such separate handles are peculiarly subject to being lost or misplaced, further complicating and delaying the hatch opening and closing procedure.

Furthermore, the latching mechanisms of existing hatch covers are typically unnecessarily complex, having numerous moving parts and depending on close tolerances between such parts for their successful operation. Such mechanisms are particularly subject to malfunction when fouled by corrosion or when worn.

The most common prior hatch covers have also encountered sealing problems because of the nature of the seal employed and because sealing pressure has been applied at only two points about the perimeter of the cover.

Many prior hatch covers also have latching mechanisms which obstruct the hatch opening when the cover is removed from the opening.

Hatch covers and analogous closures illustrative of the known state of the art and of the foregoing problems are disclosed in the following U.S. Pat. Nos. 1,204,221; 1,416,308; 1,458,391; 1,659,202; 2,283,371; 2,327,716; 2,408,733; 2,447,464; 2,470,776; 2,488,524; 2,546,760; 3,155,052; and 3,821,935.

In view of the foregoing there is a need for an improved hatch cover which has the capability of forming a watertight seal after repeated closures, which is free of jamming and other malfunction despite long exposure to salt water, and which eliminates the problem of lost or misplaced latch-actuating handles.

SUMMARY OF THE INVENTION

In accordance with the present invention an improved hatch cover has a vastly simplified latching and sealing mechanism which eliminates the reliance on screw threads for its latching and sealing action and which is characterized by very loose interfitting moving parts which enable the mechanism to perform its latching and sealing function even when heavily corroded.

Another feature of the hatch cover of the invention is an improved integral handle which cannot be lost or misplaced and which can be stored out of the way in the hatch cover when not in use so as not to be a hazardous obstruction on the deck when not in use.

The improved hatch cover also features latching arms which apply sealing pressure to the rim of the hatch opening at spaced points about the opening through a unique camming action of the laching mechanism which does not rely on screw threads or other parts affected by corrosion. A special double-lipped resilient sealing ring on the hatch cover ensures a fluid-tight seal when sealing pressure is applied by the latching arms.

The latching mechanism of the improved hatch cover also features a unique rotatable hub which when rotated to a limited extent in one direction extends the latching arms into latching engagement with the rim of the hatch opening and causes the arms to apply a clamping pressure to the ring to urge the cover into tight seated engagement with the rim because of the interaction of the described latching mechanism with camming surfaces as the hub rotates.

The aforementioned hub is rotated by a unique sliding shaft extending axially through the hub and hatch cover and capable of axial sliding movement and rotation relative to such hatch cover and hub. One end of the shaft on the hub side of the cover carries a pin or other projection which selectively engages a portion of the hub when the shaft is slid axially and rotated to a predetermined position. A handle fixed to the other end of the shaft is used to slide and rotate the shaft to actuate the latching mechanism.

Primary objects of the invention are:

a. To provide a hatch cover that will effectively seal a hatch opening closed even after repeated closures;

b. To provide a hatch cover with an improved latching mechanism that will operate satisfactorily even when corroded;

c. To provide a hatch cover with an effective latching and sealing mechanism as aforesaid which is simplified as compared to prior such mechanisms;

d. To provide a hatch cover and rim assembly which will provide a simple and effective fluid sealing of the hatch opening even after repeated closures of the hatch opening;

e. To provide a hatch cover with an improved latch-actuating mechanism; and f. To provide an improved operating handle for a hatch cover which can remain on its shaft and be stored in the hatch cover when not in use. The foregoing and other objects, features and advantages of the present invention will become more apparent from the following detailed description which proceeds with reference to the accompanying drawings.

BRIEF DESCRIPTION OF THE DRAWINGS

In the drawings:

FIG. 1 is a perspective view of the top of a hatch cover assembly in accordance with the invention with an edge portion of the assembly broken away to reveal the sealing interrelationship between the hatch cover and the surrounding rim of the hatch opening;

FIG. 2 is a perspective view of the bottom of the hatch cover assembly of FIG. 1 on an enlarged scale with a portion of the rim of the hatch opening broken away;

FIG. 3 is a bottom plan view of the hatch cover assembly of FIGS. 1 and 2 with a portion of the rim broken away;

FIG. 4 is a sectional view of the assembly taken approximately along the line 4—4 of FIG. 1 but showing the handle of the hatch cover in its raised position;

DESCRIPTION OF PREFERRED EMBODIMENT

FIG. 1 Form

Figure 5:
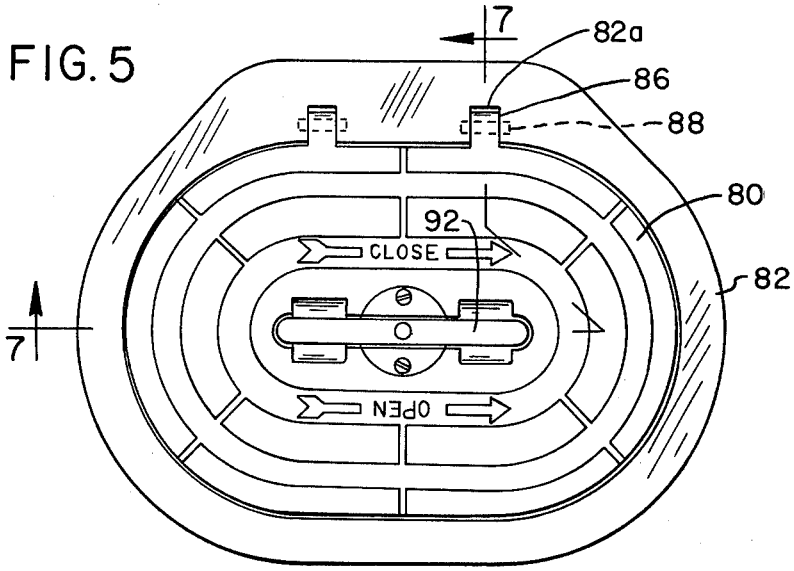
FIG. 5 is a top plan view of a modified hatch cover assembly in accordance with the invention.

Referring first to FIGS. 1–4, a circular plate-like cast metal hatch cover 10 closes a hatch opening defined by a circular metal rim or ring 12. Rim 12 of the hatch opening preferably forms a part of the hatch assembly with the hatch cover, to be affixed as by welding to the deck 14 of a ship or other vessel at the time of installation of the hatch cover to ensure a proper fit. In cross section rim 12 is an angular member which includes a top flange 12*a* adapted to overlap and join deck 14. Top flange 12*a* is joined by a web portion 12*b* to a bottom flange 12*c* which forms a seat for supporting hatch cover 10.

Hatch cover 10 has a top side 10*a* and a bottom side 10*b*. The top side has a series of concentric, alternating annular lands 16 and shallow grooves 18 and radial grooves 20 which define together a nonskid top surface that drains water from the lands into the grooves to provide a firm footing when the deck is wet.

Bottom surface 10*b* has a series of integral radial reinforcing ribs 22 for rigidity under load. Bottom surface 10*b* also has an annular groove near its outer perimeter which receives sealing means in the form of a resilient elastomeric sealing ring 24 which forms a fluid-tight seal with seat flange 12*c* of rim 12 when the hatch cover is seated and clamped against the rim. As shown best in FIGS. 4 and 7, sealing ring 24 has double lip portions 24*a* which tend to spread into tight sealing engagement with the rim and enhance its sealing effectiveness when the cover is clamped to the rim.

Three latching or locking arms 26 are symmetrically arranged about the bottom of the hatch cover and radiate from a central portion of the hatch cover and terminate near its outer periphery. The inner ends of the latching arms are connected to a rotatable arm-actuating latching hub 28 by universal connecting means comprising ball-and-socket type connections 30. The radially inner ends of the arms form the ball portions of the connections, and the hub forms the socket portions. Together the three latching arms and hub define part of a latching means or assembly for latching and sealing the cover tightly to rim 12.

The three latching arms are connected loosely to the bottom of cover 10 between their opposite ends by additional universal type connecting or retention means. Such means for each arm includes an elongated slot 32 extending through the arm near its outer end and a retaining screw or stud 34 extending through the slot and threaded at one end into an enlarged portion 35 of one of the reinforcing ribs 22 of the cover as shown in FIGS. 2 and 4. The outer end of screw 34 outwardly of the arm has an enlarged head portion 36 covering slot 32 formed by a washer and nut assembly. Such connecting means enables each arm to move to a limited extent both longitudinally and pivotally about axes both perpendicular and parallel to the plane of the cover.

Latching arms 26 are of a length such that when they are in true radial positions with respect to the axis of rotation of the hub, they overlap the bottom flange of rim 12 to prevent removal of the hatch cover from the hatch opening. By rotating hub 28 to a limited extent, the inner ends of arms 26 are shifted from their true radial positions, withdrawing the arms inwardly from rim 12 as shown in dashed lines in FIG. 3 and as permitted by the loose slotted connection between the arms 26 and the cover at retention screws 34, and permitting removal of the hatch cover from the hatch opening.

Arm-actuating hub 28 is a two-piece assembly including an inner base member 38 and an outer collar member 40 joined together by screws 41. At their intersections they form the socket portions of the ball-and-socket connections 30 for each of the three arms 26. A central opening 42 extends through both base and collar of the hub. Opening 42 enables the hub assembly to be slidably and rotatably received on a retaining collar portion 44 of cover 10. Thus hub 28 is both freely rotatable and freely slidable on retaining collar 44 within the limits permitted by the retention screw assembly 34 and the ball-and-socket connections. Retaining collar 44 is fastened to the remainder of cover 10 by screws 45, shown in FIG. 1.

The base 38 of hub 28 has three laterally projecting ears 38*a* with holes therethrough which receive cam bearings 46, preferably made of a hard, low-friction material such as nylon. The bottom surface 10*b* of the hatch cover is formed with raised central inclined cam surfaces 48 on which the cam bearings 46 of the hub ride. Inclined cam surfaces 48 are shaped, arranged and positioned in a circular path such that as the hub rotates in a hatch-closing direction and as latching arms 26 overlap the rim and approach their fully extended positions, cam bearings 46 ride up inclined cam surfaces 48 of the cover, forcing the hub outwardly along collar 44 away from the cover. As the hub shifts outwardly, the connected inner ends of locking arms 26 also move outwardly away from the cover, causing such arms to fulcrum about retention screws 34 and thereby force their outer ends 26*a* inwardly against the bottom flange of rim 12. As a result, outward reaction forces are applied at the fulcrum points against the heads of retention screws 34, to leverage the cover into tight seated and fluid-sealed engagement with rim 12.

Of course, rotation of the hub in the opposite, hatch-opening direction has the opposite effect, first causing the cam bearings 46 to ride down the inclined plane of cam surfaces 48 to release outer ends 26*a* of the locking arms from clamping engagement with the rim and then withdrawing such arms from the rim to enable removal of the hatch cover.

Means are provided for rotating hub 28 to activate the latching arms 26 and camming means. Such rotation means includes a shaft 50 which extends centrally through retaining collar 44 of the cover and through hub 28, projecting at one end from the hub and at its opposite end from the top surface of the cover. The shaft can normally rotate and slide axially relative to the cover and hub. A simple straight handle 52 is affixed to the upper end of the shaft.

Means are provided on a lower end portion of the shaft below the cover for selective operating engagement with the hub. In the illustrated embodiment, such means includes a pin 54 projecting laterally from diametrically opposite sides of the shaft near its lower end. When handle 52 is in a lowered position against or near the top surface of the cover, pin 54 is below and out of operating engagement with the lower end of hub 28 so that turning of handle 52 will not rotate the hub. However, the lower end surface of hub 28 has diametrically opposed slots 56 which receive pin 54 when handle 52 is raised and rotated to align the pin with such slots. When pin 54 is within the hub slots 56, rotation of handle 52 to rotate shaft 50 also rotates hub 28 to actuate the latching arms 26.

The central shaft passage of retaining collar 44 carries an O-ring seal 58 near its upper end to prevent seepage of water through the passage between the collar and shaft.

If desired, and as shown clearly in FIG. 1, arrows and words indicating the directions of opening and closing of the cover can be cast into the surface of the cover.

A stop 60 is also cast into the bottom surface of the cover to determine the limits of rotation of the hub in a direction to latch the cover. Without such stop, continued rotation of the hub in a "latching" or "closing" direction would shift the latching arms beyond their true radial positions to withdraw the arms from overlapping engagement with the rim.

The upper surface of cover 10 has a recessed surface portion 62 shaped to receive and store handle 52 when the shaft is disengaged from the hub. Recess 62 is of a depth such that the upper surface of the handle will be flush with upper surface 10*a* of the hatch cover when the handle lies fully within the recess. In this way the handle need not be disconnected from the shaft when not in use and will not be an obstruction to persons walking over the deck. The elongated recess 62 extends diametrically across the upper surface of the hatch cover and has enlarged rectangular well portions 64 near its opposite ends. The well portions extend laterally beyond and to a depth greater than the remainder of recess 62 so that the handle can be readily gripped and withdrawn from the recess of the cover to its raised operating position shown in dashed lines in FIG. 1 and in full lines in FIG. 4.

FIG. 5 Form

Figure 6:
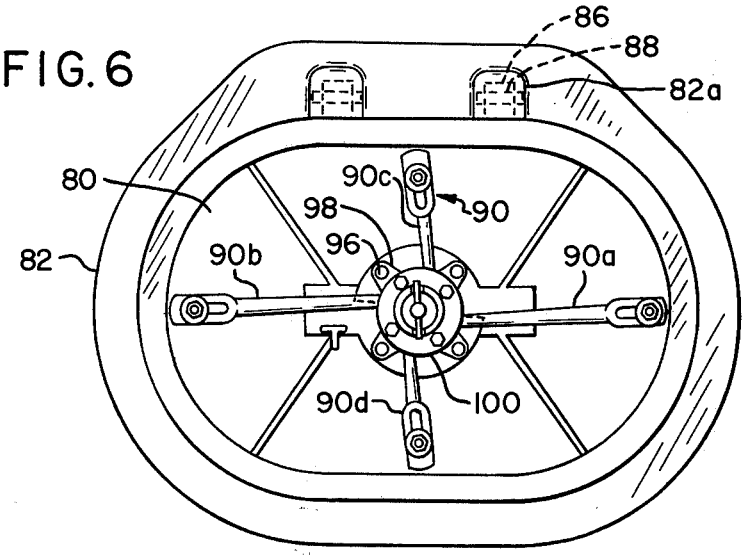
FIG. 6 is a bottom plan view of the hatch cover assembly of FIG. 5 showing the latching mechanism in its retracted, inactive position.
Figure 7:
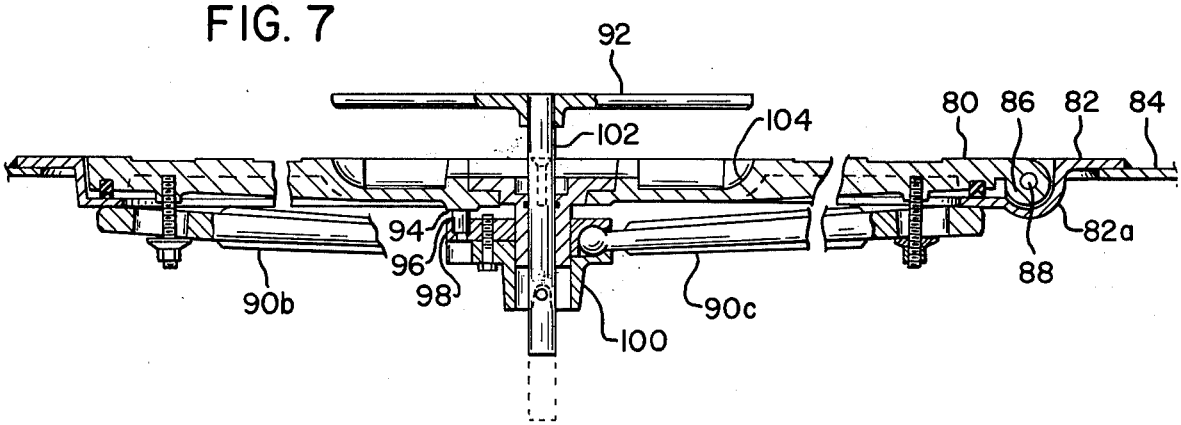
FIG. 7 is a sectional view of the modified hatch cover assembly taken along the lines 7—7 of FIG. 5 but showing the latching mechanism in its extended, latching position and the operating handle in an operating position.

The hatch cover modification of FIGS. 5–7 is similar to the hatch cover previously described except that the former is oblong rather than round, is hinged to the rim surrounding the hatch opening, and has four latching arms rather than three.

Oval hatch cover 80 is adapted to seat against the bottom flange of the correspondingly oval-shaped deck ring or rim 82 which in use is welded to the deck 84 of a ship or other vessel. A long straight-sided portion of the cover has an integrally formed pair of hinges 86 hinged by pins 88 to a concavely curved seat portion 82*a* of rim 82. The top flange portion of rim 82 in the area of hinges 86 is wider than the remaining top flange of the rim, as will be apparent from FIG. 5. With the cover being hinged and with the latching arms 90 retracted from the lower flange of the rim as shown in FIG. 6, cover 80 can be swung open or closed by gripping the handle 92 in its raised position as shown in FIG. 7.

As shown in FIG. 6, there are four latching arms 90 arranged in generally radially opposed pairs symmetrically about the bottom of the cover. One pair 90*a*, 90*b* extends toward the opposite ends of the cover and is necessarily longer than the shorter pair 90*c*, 90*d* which extend toward the opposite sides of the cover.

Since there are four latching arms, there need to be four corresponding inclined camming surfaces on the central portion of the bottom of the cover. One such camming surface 94 is shown in FIG. 7. These camming surfaces coact with four cam bearings 96 held within four ear portions 98 of a rotatable locking hub 100.

Except for the foregoing differences, the hatch cover of FIG. 5 has the same advantageous features as the hatch cover of FIG. 1, including the handle 92 on the arm-actuating shaft 102 which can be stored within a recess 104 in the top surface of cover 80 so as to be flush with such surface when not in use.

Operation

Operation of the hatch cover will be explained with reference to the hatch cover of FIG. 1 with the understanding, of course, that the same description will apply to the operation of the hatch cover of FIG. 5 except that the latter hatch cover, being hinged at one side, cannot be completely removed from rim 82 of the hatch opening.

To insert the hatch cover over the hatch opening, the cover is grasped by its handle 52 with the handle in its raised position as shown in FIG. 4 and turned to a position in which the shaft pin 54 engages hub slots 56 and the arms are retracted. The cover is carried over the hatch opening and lowered onto bottom flange 12*c* of rim 12. The handle is then rotated in a counterclockwise direction as viewed in FIG. 1 to rotate shaft 50 and cause shaft pin 54 to rotate locking hub 28, thereby extending locking arms 26 until they overlap bottom flange 12*c* of the rim 12. Near the end of such rotation, the hub is cammed outwardly away from the cover by camming surfaces 48, pivoting the locking arms 26 about their retention studs 34 to force the outer ends of the arms against the rim and leverage cover 10 tightly into sealed engagement with the rim, as shown in FIG. 4. During the cover-latching operation, the handle is turned in the "close" direction until it can be turned no more because of one of arms 26 engaging stop 60. Stop 60 determines the fully latched and sealed condition of the hatch cover.

With the cover sealed in place, handle 52 is pushed downwardly, sliding shaft 50 through the cover and hub to disengage shaft pin 54 from the hub. Thereafter handle 52 can be turned into alignment with cover recess 62 without turning the hub and then pushed into the recess for storage.

To remove the cover from the hatch opening, handle 52 is lifted from its cover recess 62 and turned until shaft pin 54 engages hub slot 56. This can be determined by feel. When the shaft pin engages the hub slot, handle 52 is turned in a clockwise direction as shown in FIG. 1 until arms 26 clear the bottom flange of rim 12, after which the cover can be lifted from the hatch opening by its handle 52. The degree to which the handle 52 can be turned in its clockwise direction is limited by the ball-and-socket joints 30 joining the locking arms to the hub. Such joints permit the arms to be withdrawn only to a position in which the outer ends of the arms just clear the rim to permit removal of the hatch cover.

In the preferred embodiments shown, the camming surface means are provided on the cover for coaction with bearing surfaces of the hub to pivot the latching arms about their fulcrums and thereby transfer closing forces through the fulcrums to the cover. Alternatively, such closing forces can be transferred from such arms through their fulcrums to the cover by providing such camming surface means either on the rim of the hatch opening or on the outer ends of the arms to pivot the outer ends of the arms outwardly away from the cover and rim.

Having illustrated and described the principles of my invention with reference to what are presently two preferred embodiments, it should be apparent to those persons skilled in the art that such invention may be modified in arrangement and detail without departing from such principles. I claim as my invention all such modifications as come within the true spirit and scope of the following claims.

I claim:

1. A plate-like hatch cover for closing a hatch opening comprising:

a cover plate, and a rim surrounding said opening including a rim flange forming a seat for said cover plate so that one side of said cover plate seats against an opposite side of said rim flange, latching means including a latching hub rotatably on said one side of said cover plate and plural latching arms extending generally radially in different directions on said one side of said plate from said hub toward said rim for latching said cover plate to said rim flange, connecting means pivotally connecting the inner ends of said latching arms to said latching hub and retention means loosely connecting intermediate portions of said arms to said cover plate and permitting said arms to extend generally radially outwardly into overlapping relation to one side of said rim flange corresponding to said one side of said cover plate when said hub rotates to a limited extent in one direction and so that said arms retract radially inwardly to clear said rim flange when said hub rotates to a limited extent in an opposite direction, hub-rotating means for rotating said hub in opposite directions on said cover plate, and camming surface means cooperable with said latching means and said retention means upon rotation of said hub in said one direction by said hub-rotating means to extend said arms and cause the outer ends of said arms to pry against said one side of said rim flange using said retention means as a fulcrum to urge an outer peripheral portion of said cover plate into tight seated engagement with said opposite side of said rim flange.

2. Apparatus according to claim 1 wherein said camming surface means comprises camming surfaces on a central portion of said one side of said cover plate in cooperative engagement with cam bearings on said hub.

3. Apparatus according to claim 2 wherein said connecting means include ball-and-socket type connecting means connecting said arms to said hub and said retention means loosely connects intermediate portions of said arms to said cover plate while enabling extension and retraction of said arms and limited movement of the outer and inner ends of said arms toward and away from said one side of said cover plate about said retention means as a fulcrum, said camming surface means being operable to shift said hub outwardly away from said cover plate during its rotation in said one direction to extend said arms, so as to shift the inner ends of said arms outwardly also about said retention means as a fulcrum thereby to shift the outer ends of said arms inwardly against said one side of said rim flange to urge said one side of said cover plate into seated engagement with said opposite side of said rim flange.

4. Apparatus according to claim 1 including annular resilient sealing means on said one side of said cover adjacent to the outer periphery thereof for forming a fluid-tight seal with said rim flange when said cover is in tight seated engagement with said rim flange, said sealing means including a double annular lip portion for engagement with said rim flange.

5. A plate-like hatch cover for closing a hatch opening comprising:

latching means including a latching hub rotatable on one side of said cover and plural latching arms extending in different directions from said hub toward a rim of said hatch opening for latching said cover to said rim, connecting means connecting the inner ends of said latching arms to said latching hub and intermediate portions of said arms to said cover so that said arms are extended into overlapping relation to said rim when said hub rotates to a limited extent in one direction and so that said arms are retracted to clear said rim when said hub rotates to a limited extent in an opposite direction, means for rotating said hub in opposite directions, and camming surface means cooperable with said latching means and said connecting means in a manner such that rotation of said hub in said one direction to extend said arms also causes said arms to urge said cover into tight seated engagement with said rim, said means for rotating said hub including a threadless shaft extending centrally through said hub and said cover plate and being axially slidable through and rotatable relative to said hub and said cover plate, said shaft including means selectively engageable with said hub for rotating said hub upon rotation of said shaft.

6. A plate-like hatch cover for closing a hatch opening comprising:

latching means including a latching hub rotatable on one side of said cover and plural latching arms extending in different directions from said hub toward a rim of said hatch opening for latching said cover to said rim, connecting means connecting the inner ends of said latching arms to said latching hub and intermediate portions of said arms to said cover so that said arms are extended into overlapping relation to said rim when said hub rotates to a limited extent in one direction and so that said arms are retracted to clear said rim when said hub rotates to a limited extent in an opposite direction, means for rotating said hub in opposite directions, and camming surface means cooperative with said latching means and said connecting means in a manner such that rotation of said hub in said one direction to extend said arms also causes said arms to urge said cover into tight seated engagement with said rim, said means for rotating said hub including a shaft extending centrally through said hub and said cover and being axially slidable and rotatable relative to said hub and said cover, said shaft including means selectively engageable with said hub for rotating said hub upon rotation of said shaft, handle means for rotating said shaft, said handle means being affixed to one end of said shaft on the side of said cover opposite said one side, said opposite side of said cover having a recessed surface portion for storing said handle means when not in use, said handle means being movable into said recessed surface portion by sliding said shaft axially through said cover and hub.

7. Apparatus according to claim 6 wherein said means on said shaft selectively engageable with said hub comprises a lateral projection from said shaft engageable with said hub for effecting rotation only when said handle means is withdrawn outwardly of said recessed surface portion of said cover.

8. Apparatus according to claim 1 wherein said plural latching arms include at least three said arms arranged symmetrically about said one side of said cover.

9. Apparatus according to claim 1 wherein said plural latching arms include at least four said arms arranged symmetrically about said one side of said cover.

10. Apparatus according to claim 1 including hinge means on said cover hinging an edge portion of said cover plate to said rim.

11. Apparatus according to claim 1 wherein said cover plate is oblong and hinged along a long side thereof to said rim, said cover plate having four said latching arms symmetrically arranged about said one side of said cover.

12. Apparatus according to claim 6 wherein said recessed surface portion of said cover is elongate and extends diametrically across said cover and is recessed to a depth so as to store said handle means flush with the outermost surface portion of said cover, said recessed surface portion including a pair of enlarged recesses near the opposite ends of said recessed surface portion extending to a greater depth and greater width than the remainder of said recessed surface portion to facilitate gripping and removing said handle means therefrom.

13. Apparatus according to claim 2 wherein said cam bearing means is composed of a low friction, wear resistant material.

14. Apparatus according to claim 5 wherein said cover plate includes a central opening therethrough for slidably receiving said shaft and fluid sealing means between said shaft and the walls of said opening for preventing leakage of fluid through said opening between the opposite sides of said cover plate.

15. Apparatus according to claim 1 wherein said rim comprises in addition to said first-mentioned rim flange a second rim flange parallel to and offset outwardly and laterally from said first rim flange such that with said one side of said cover in seated engagement with said first rim flange the opposite side of said cover plate is substantially flush with said second rim flange.

16. Apparatus according to claim 1 wherein said camming surface means is cooperable with said latching means and said retention means upon rotation of said hub in said one direction in a manner to urge a central portion of said cover plate in a direction opposite the direction of urging of said outer peripheral portion of said cover plate so as to stress said cover plate to resist loads directed axially against said central portion from said opposite side thereof.

17. Apparatus according to claim 1 including stop means on said one side of said cover plate for limiting rotation of said latching hub in the latching direction to provide a uniform locking force upon repeated closures of said opening.

18. Apparatus according to claim 1 wherein said retention means for each arm is individually adjustable to regulate the prying force of said arm with respect to said rim upon operation of said camming surface means.

* * * * *